US009058955B2

(12) United States Patent
Roberts

(10) Patent No.: US 9,058,955 B2
(45) Date of Patent: Jun. 16, 2015

(54) LAMP COMPRISING ACTIVE COOLING DEVICE FOR THERMAL MANAGEMENT

(71) Applicant: GE Lighting Solutions, LLC, East Cleveland, OH (US)

(72) Inventor: Bruce Richard Roberts, Mentor-on-the-Lake, OH (US)

(73) Assignee: GE LIGHTING SOLUTIONS, LLC, East Cleveland, OH (US)

( * ) Notice: Subject to any disclaimer, the term of this patent is extended or adjusted under 35 U.S.C. 154(b) by 1 day.

(21) Appl. No.: 13/706,592

(22) Filed: Dec. 6, 2012

(65) Prior Publication Data

US 2014/0159573 A1 Jun. 12, 2014

(51) Int. Cl.

| | |
|---|---|
| ***H05B 37/02*** | (2006.01) |
| ***H01J 7/46*** | (2006.01) |
| ***F21K 99/00*** | (2010.01) |
| *F21Y 101/02* | (2006.01) |

(52) U.S. Cl.

CPC . *H01J 7/46* (2013.01); *F21K 9/135* (2013.01); *F21Y 2101/02* (2013.01); *F21V 29/63* (2015.01)

(58) Field of Classification Search

CPC ..... H05B 33/00; H05B 33/0803; H05B 33/0851; H05B 43/00; H05B 33/0815; H05B 33/0818; H05B 33/22; F21K 9/13; F21K 9/135; F21Y 2101/02; F21Y 2111/007; F21V 3/00; F21V 29/02; F21V 29/2293; F21V 29/2206; F21V 29/2218; F21V 29/405; H01F 29/10; H01J 23/10; H01J 25/587

USPC ..... 315/32, 39.59, 39.71, 55, 291, 309, 315/283, 285; 362/255, 257, 227, 240, 362/249.02, 271, 264, 265, 294, 362, 373, 362/377

See application file for complete search history.

(56) References Cited

U.S. PATENT DOCUMENTS

| | | | | |
|---|---|---|---|---|
| 4,878,352 | A | 11/1989 | Weber et al. | |
| 6,679,771 | B2 | 1/2004 | Lee | |
| 7,344,279 | B2 * | 3/2008 | Mueller et al. | 362/294 |
| 7,698,930 | B2 | 4/2010 | Gordaninejad et al. | |
| 8,027,140 | B2 | 9/2011 | Owen et al. | |
| 8,066,874 | B2 | 11/2011 | Burba, III et al. | |
| 8,172,435 | B2 * | 5/2012 | Spiro et al. | 362/391 |
| 8,444,299 | B2 * | 5/2013 | Chou et al. | 362/294 |
| 8,564,217 | B2 * | 10/2013 | Han et al. | 315/291 |
| 8,579,476 | B2 * | 11/2013 | Mahalingam et al. | 362/373 |
| 8,901,842 | B2 * | 12/2014 | Roberts | 315/248 |
| 8,931,933 | B2 * | 1/2015 | Tong et al. | 362/373 |
| 2003/0190884 | A1 | 10/2003 | Lee | |
| 2005/0104461 | A1 | 5/2005 | Hatz et al. | |
| 2006/0177323 | A1 | 8/2006 | Hsieh | |
| 2011/0241350 | A1 | 10/2011 | Kori et al. | |
| 2013/0068427 | A1 * | 3/2013 | Williams et al. | 165/121 |
| 2013/0163243 | A1 * | 6/2013 | Reed | 362/235 |
| 2013/0294068 | A1 * | 11/2013 | Kuenzler et al. | 362/234 |

* cited by examiner

*Primary Examiner* — Haiss Philogene

(74) *Attorney, Agent, or Firm* — GE Global Patent Operation; Peter T. DiMauro

(57) ABSTRACT

Embodiments of a lamp comprise a light source and an active cooling device that propagates airflow within the lamp to dissipate heat from the light source. In one embodiment, the lamp comprises a light emitting diode (LED) device and an inductor that couples in series with the light emitting diode (LED) device. The lamp also comprises a diaphragm magnetically coupled with the inductor, wherein the diaphragm can flex between a first position and a second position to generate the air flow.

18 Claims, 5 Drawing Sheets

LAMP COMPRISING ACTIVE COOLING DEVICE FOR THERMAL MANAGEMENT

BACKGROUND

The subject matter of the present disclosure relates to lamps and lighting devices and, in particular, to embodiments of a lamp that combines a high-efficiency light source with thermal management using an active cooling device, e.g., a synthetic jet ejector.

Incandescent light bulbs have been available for over 100 years. Other types of light sources for lamps, however, show promise as commercially viable alternatives to the incandescent light bulb. Lamps that utilize high-efficiency light devices (e.g., light-emitting diode (LED) devices) are attractive because these devices save energy through high-efficiency light output. Moreover, LED devices and other solid-state lighting technologies offer performance that is superior to incandescent lamps. For example, the useful lifetime (e.g., lumen maintenance and reliability over time) of incandescent lamps is typically in the range about 1000 to 5000 hours. Lamps that utilize LED devices, on the other hand, may operate in excess of 25,000 hours and, perhaps, as long as 100,000 hours or more.

Several factors can affect the quality of performance of lamps that utilize LED devices as the light source. For example, many LED devices use a direct current (DC) input. Lamps with LED devices must generate a DC input from the alternating current (AC) input, which is the common power supply in home and/or office settings. This feature can affect operation of the LED devices. For example, ripple and other anomalies that might prevail in the DC input due, at least in part, to conversion of the AC input to the DC input as well as in connection with other operational components in the lamp. Such anomalies can affect performance of the LED devices.

LED devices are also sensitive to high temperatures, which can affect both performance and reliability as compared with incandescent or halogen lamps. However, LED devices are known to convert a significant portion of the DC input to thermal energy. Lamps that use LED devices often include an efficient thermal management system that dissipates heat to maintain the light source at an acceptable operating temperature and to achieve adequate lifetime. Physical constraints on size and packaging of the lamp, however, further complicate the task of heat dissipation. For example, regulatory limits define the maximum dimensions for an envelope in which all the lamp components must fit. This envelope limits choices for the design and layout of features and devices that would otherwise dissipate heat properly from the lamp.

To this end, thermal management devices that dissipate heat in lamps that deploy LED devices are known. Some of these devices use conventional fans, piezoelectric elements, and synthetic jet ejectors. The latter type, i.e., synthetic jet ejectors, utilize a diaphragm that flexes, e.g., in response to an AC input. Flexing of the diaphragm propagates airflow over the LED devices and/or throughout the lamp. This configuration of elements offers efficient and versatile cooling at a local level, e.g., the light source. However, although packaging of the synthetic jet ejector particularly suits the envelope and other construction of lamps with LED devices, this type of cooling mechanism typically utilizes expensive components. These components may sometimes fail to meet cost and sustainability requirements necessary to make lamps with LED device and solid state technology a robust alternative to incandescent and halogen-based bulb technology.

BRIEF DESCRIPTION OF THE INVENTION

This disclosure describes, in one embodiment, a lighting device that comprises a light source and a field generator electrically coupled with the light source. The field generator generates a magnetic field in response to a first input signal that energizes the light source. The lighting device also comprises an actuator magnetically coupled with the field generator via the magnetic field.

This disclosure also describes, in one embodiment, a lighting device that comprises a light emitting diode device. The lighting device also comprises an active cooling device forming a series circuit with the light emitting diode device and a ground. The active cooling device generates a magnetic field in response to a first input signal that energizes the light emitting diode device.

This disclosure further describes, in one embodiment, a lighting device that comprises a drive circuit generating a first input signal and a second input signal that is different from the first input signal. The lighting device also comprises a light emitting diode device coupled with the drive circuit to receive the first input signal and a first inductor coupled in series with the light emitting diode device to conduct the first input signal to ground; and a diaphragm magnetically coupled with the first inductor, wherein the diaphragm comprises material that flexes between a first position and a second position in response to the second input signal from the drive circuit.

Other features and advantages of the disclosure will become apparent by reference to the following description taken in connection with the accompanying drawings.

BRIEF DESCRIPTION OF THE DRAWINGS

Reference is now made briefly to the accompanying drawings, in which.

Where applicable like reference characters designate identical or corresponding components and units throughout the several views, which are not to scale unless otherwise indicated.

DETAILED DESCRIPTION

Broadly, the discussion below focuses on embodiments of a lamp with a light source, e.g., one or more light-emitting diode (LED) device. These embodiments also incorporate an active cooling device to dissipate heat from the light source. This active cooling device generates movement of air (or other fluid) within the lighting device. The resulting airflow facilitates heat transfer, e.g., from the light source to other structures of the lighting device and/or out of the lighting device altogether. However, as set forth more below, the active cooling device uses components that are not only more cost effective as compared to conventional synthetic jet technology, but also integrate into the circuitry of the lamp to alleviate problems with ripple and other anomalies and variations in input signals that drive the LED devices. These variations can diminish the performance of the lamp.

Figure 1:
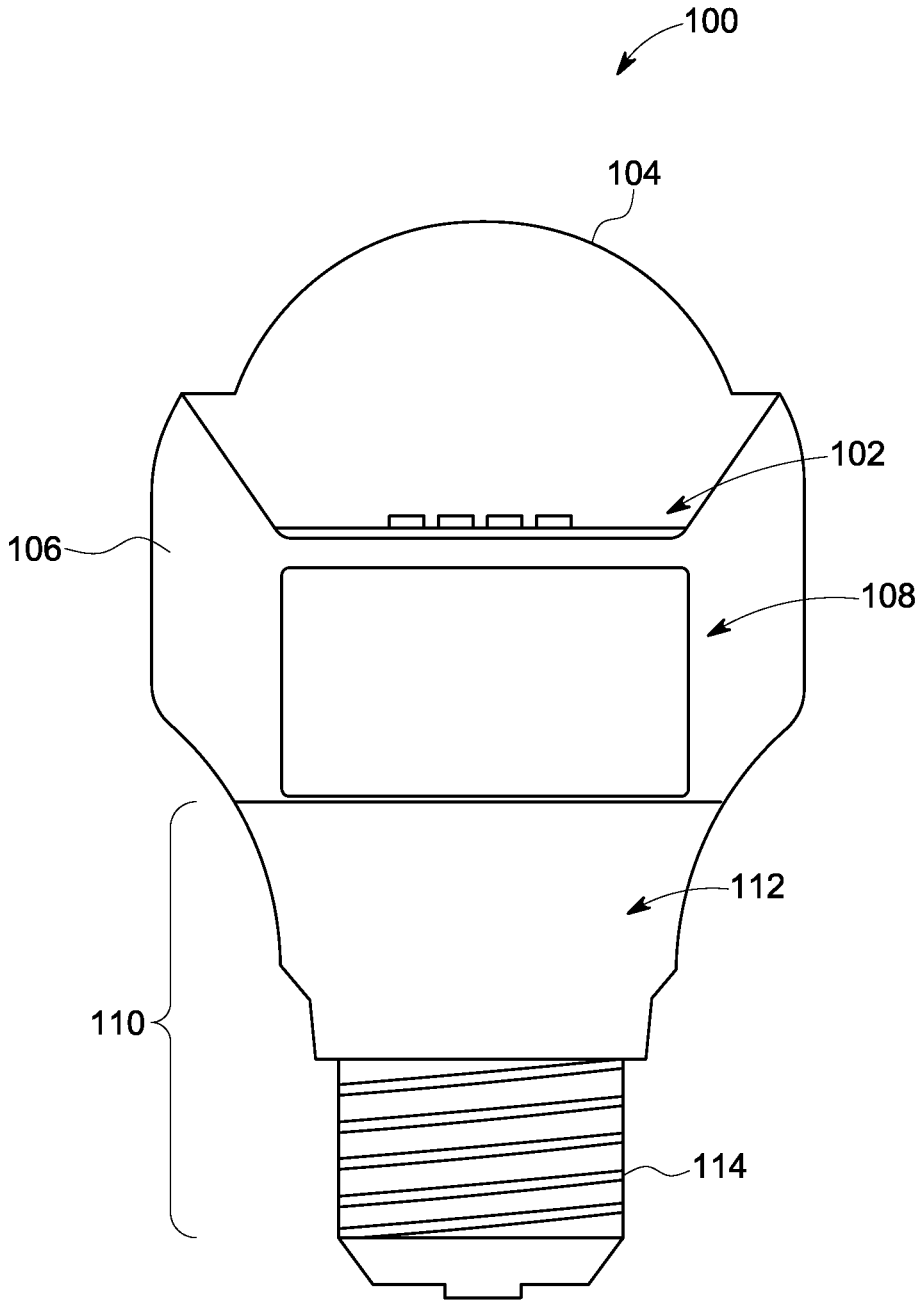
FIG. 1 depicts a side view of an exemplary embodiment of a lighting device.

FIG. 1 illustrates an exemplary embodiment of a lamp 100 that utilizes active cooling to dissipate heat. The lamp 100 includes a light source 102 and an optics assembly 104 that disperses light from the light source 102. Light source 102 may comprise one or more light-emitting diode (LED) devices. A heat dissipation element 106 (also "heat sink 106") is in thermal contact with the light source 102. The heat sink 106 can also support the optics assembly 104, as desired. The lamp 100 further includes an active cooling device 108 in flow connection with the light source 102 and/or with parts of the heat sink 106. This configuration promotes effective heat transfer from the light source 102 to avoid overheating that can negatively affect performance of the lamp 100.

Embodiments of the lamp 100 also have a base assembly 110 with a body 112 and a connector 114, both of which may house a variety of electrical elements and circuitry that drive and control the light source 102 and the active cooling module 108. Examples of the connector 114 are compatible with Edison-type lamp sockets found in U.S. residential and office premises as well as other types of sockets and connectors that can conduct electricity to the components of the lamp 100. These types of connectors outfit the lamp 100 to replace existing light-generating devices, e.g., incandescent light bulbs, compact fluorescent bulbs, etc. For example, the lamp 100 can substitute for any one of the variety of A-series (e.g., A-19) incandescent bulbs often used in light-emitting devices.

Figure 2:
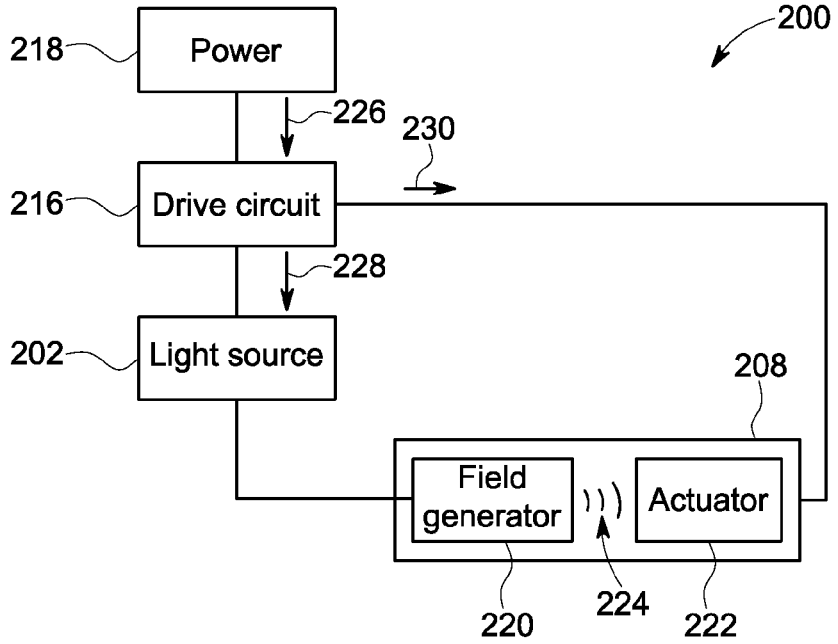
FIG. 2 depicts a schematic diagram of an exemplary embodiment of a lighting device.

FIG. 2 depicts a schematic diagram of another exemplary embodiment of a lamp 200. The lamp 200 includes a light source 202 and an active cooling module 208. The lamp 200 also has a drive circuit 216, which receives a power signal from an external power source 218, e.g., 120V AC. The drive circuit 216 couples with the light source 202 and the active cooling module 208. In one embodiment, the active cooling device 208 includes a field generator 220 and an actuator 222, which operates in a manner that causes air to flow, e.g., through the heat sink 106 (FIG. 1). The field generator 220 generates a magnetic field 224 under stimulation, e.g., from an electrical signal. In one embodiment, the field generator 220 electrically couples in series with the light source 202 and magnetically couples with the active actuator 222 via the magnetic field 224.

During operation of the lamp 200, the power source 218 provides a power input signal 226 to the drive circuit 216. The power input signal 226 can arise, for example, from a socket in a light fixture in which the lamp 200 secures. In response to the power input signal 226, the drive circuit 216 generates a first input signal 228 and a second input signal 230. The first input signal 228 energizes the light source 202 and the field generator 220. This configuration causes the light source 202 to generate light and the field generator 220 to generate the magnetic field 224. The second input signal 230 stimulates the actuator 222. In one example, the magnetic field 224 works in conjunction with rapid movement of the actuator 222 to propagate airflow for cooling the light source 202.

Examples of the field generator 220 become magnetized under electrical stimulation. This component generates the magnetic field 224 with the same characteristics as rare earth permanent magnets, but at much lower costs. To this end, use of the field generator 220 can replace the rare-earth permanent magnets that are used in connection with conventional synthetic jet devices. This feature may reduce or eliminate the costs of the rare-earth permanent magnet with components (e.g., the field generator 224) that are much less expensive. Moreover, as set forth below, coupling the field generator 220 with the light source 202 can smooth variations in the first input signal 228 that can effect operation of the light source 202.

Figure 3:
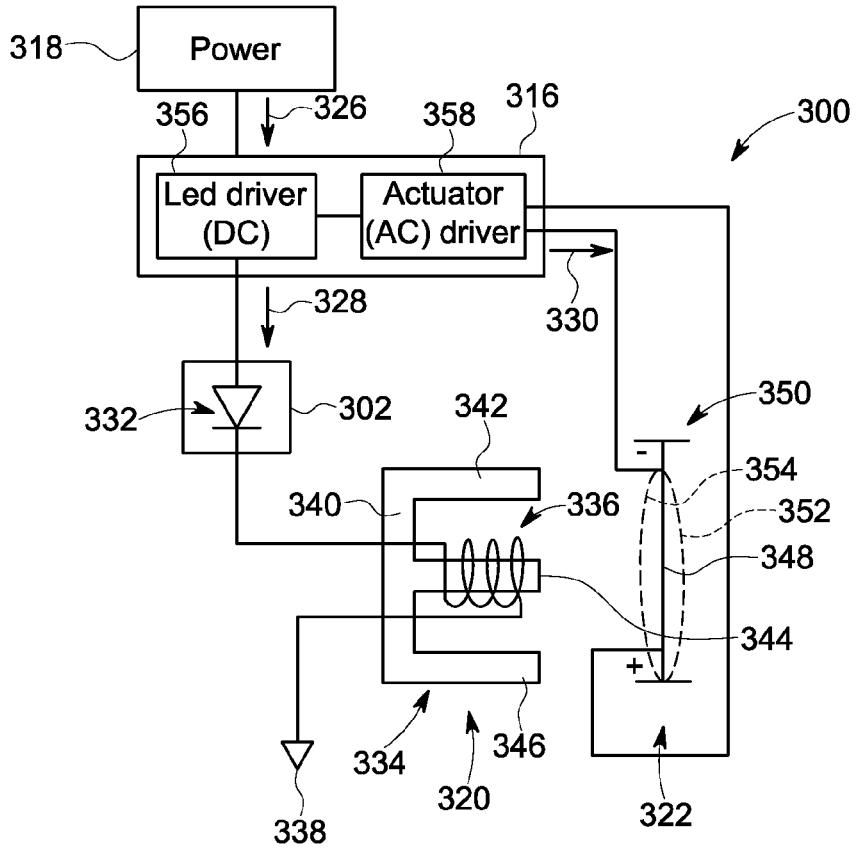
FIG. 3 depicts a schematic diagram of one construction of a lighting device, e.g., the lighting device of FIGS. 1 and 2.

FIG. 3 provides details for one exemplary construction of a lamp 300. In this construction, the light source 302 comprises a light emitting diode (LED) device 332. The field generator 320 includes a base element 334 and an inductor 336, which couples in series with the LED device 332 to conduct the first input signal to an LED driver ground 338. In one example, the base element 334 has a body 340 with a plurality of legs (e.g., a first leg 342, a second leg 344, and a third leg 346). The first leg 342 and the third leg 346 form a pair of outer legs and the second leg 344 forms an inner leg disposed therebetween. The actuator 322 includes a diaphragm 348 that is secured about a peripheral edge 350. The diaphragm 348 has a first position 352 and a second position 354. In one example, the drive circuit 316 includes an LED driver circuit 356 and an actuator driver circuit 358 that couple with, respectively, the LED device 332 and the diaphragm 348.

Examples of the LED driver circuit 356 and the actuator driver circuit 358 (collectively, "driver circuits") generate signals that energize the LED device 332, the inductor 336, and the diaphragm 348. These driver circuits can comprise various combinations of discrete and/or integrated electrical elements (e.g., transistors, resistors, capacitors, diodes, etc.). In one embodiment, the elements of the driver circuits can operate on an alternating current (AC) input (e.g., the power input signal 326). For example, the elements of the actuator driver circuit 358 can tune the waveform of the alternating current (AC) input so the resulting AC input (e.g., the second input signal 330) has parameters (e.g., current, voltage, waveform, etc.) that cause the diaphragm 348 to move (and/or oscillate) between the first position 352 and the second position 354 at a desired frequency. In one construction, the parameters of the resulting AC input determine the frequency and/or speed at which the movement of the diaphragm 348 occurs.

On the other hand, elements of the LED driver circuit 356 can convert the alternating current (AC) input to a direct current (DC) input (e.g., the first input signal 328). This DC input can have parameters (e.g., current, voltage, waveform, etc.) that comport with operation of the LED device 332. Moreover, as set forth above, although the conversion of the AC input to DC input may inject (or cause) ripple in the DC input, coupling the inductor 336 in series with the LED device 332 helps to smooth out the variations to improve performance of the LED device 332.

Form factors for the body 340 can include the "E" structure shown in FIG. 3 as well as other shapes. The selection of the shape can contemplate the required characteristics (e.g., field strength) of the magnetic field. Packaging constraints (e.g., the envelope) for the lamp 300 can also determine, at least in part, the shape and one or more of the dimensions associated therewith. In one embodiment, the body 340 comprises materials, e.g., ferrites, that become magnetized in response to stimulation of the inductor 336, e.g., by the DC input. The materials of the body 340, however, can provide the magnetic field with similar field strength as rare earth permanent magnets, but at reduced costs.

As shown in FIG. 3, the inductor 336 comprises a plurality of windings that wind about one of the legs (e.g., the second leg 344) of the body 340. The number of windings and material composition of the inductor 336, as well as the type of materials and form factor for the base element 334, can determine the strength of the magnetic field. In other configurations, the inductor 336 may have windings on each of the legs (e.g., the first leg 342, the second leg, 344, and the third leg 346). This disclosure contemplates, however, that the changes and variations to features of the base element 334 and inductor 336 (alone or in combination) can be selected to both tune the strength of the magnetic field and provide optimal (or, some level) of smoothing and filtering, e.g., to reduce ripple in the DC input.

Moreover, FIG. 3 demonstrates the use of a single-sided active cooling device where only one diaphragm is present. Therefore, only a single inductor is necessary to form the magnetic field in which the actuator signal pushes against to move the diaphragm. This is a low cost approach, but may cause unwanted vibrations that are discernable to the end user. To cancel these vibrations out, the lamp may include one or more additional diaphragms. This configuration can increase (e.g., double in the case of one additional diaphragm) the cooling capacity and, when the diaphragms operate 180 degrees out of phase with each other, cancels most of the unwanted vibrations. The disclosure illustrates embodiments in FIGS. 4 and 5 that utilize a plurality of diaphragms to illustrate this construction.

Figure 4:
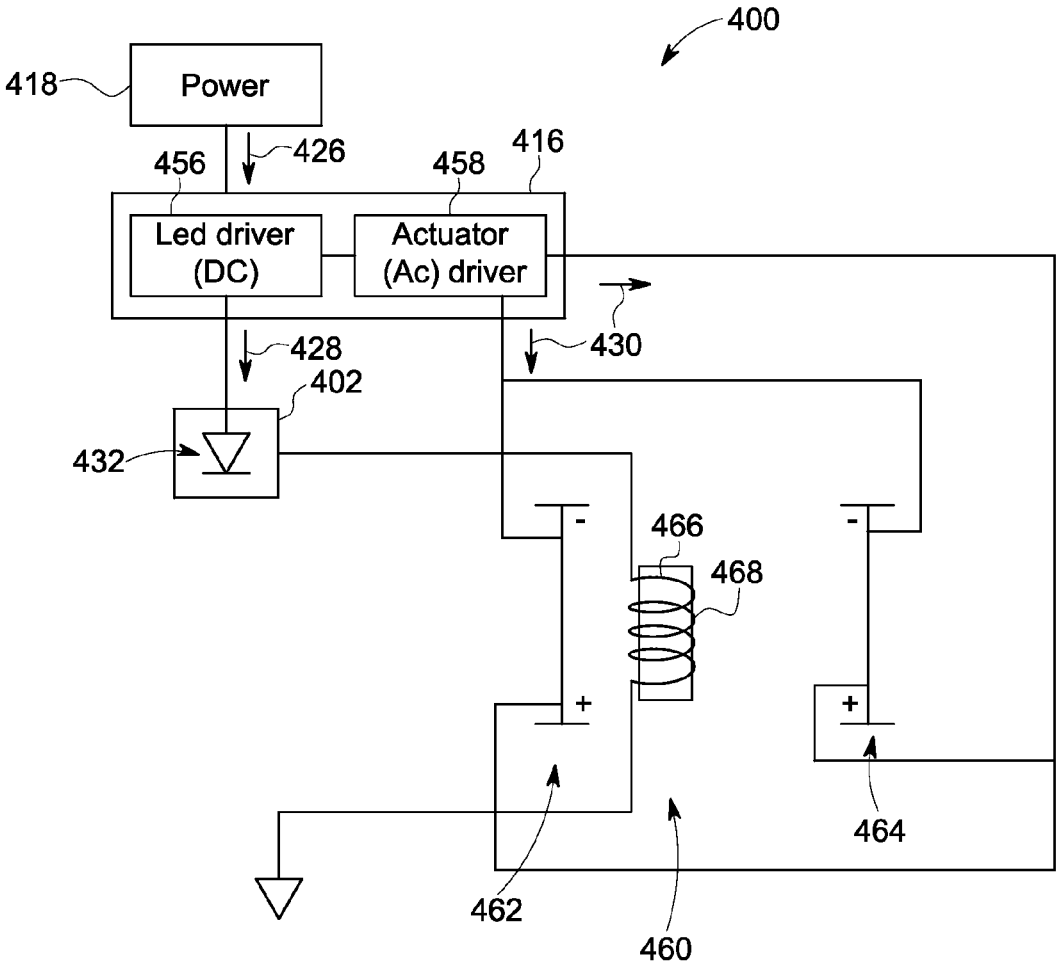
FIG. 4 depicts a schematic diagram of another construction of a lighting device, e.g., the lighting device of FIGS. 1 and 2.
Figure 5:
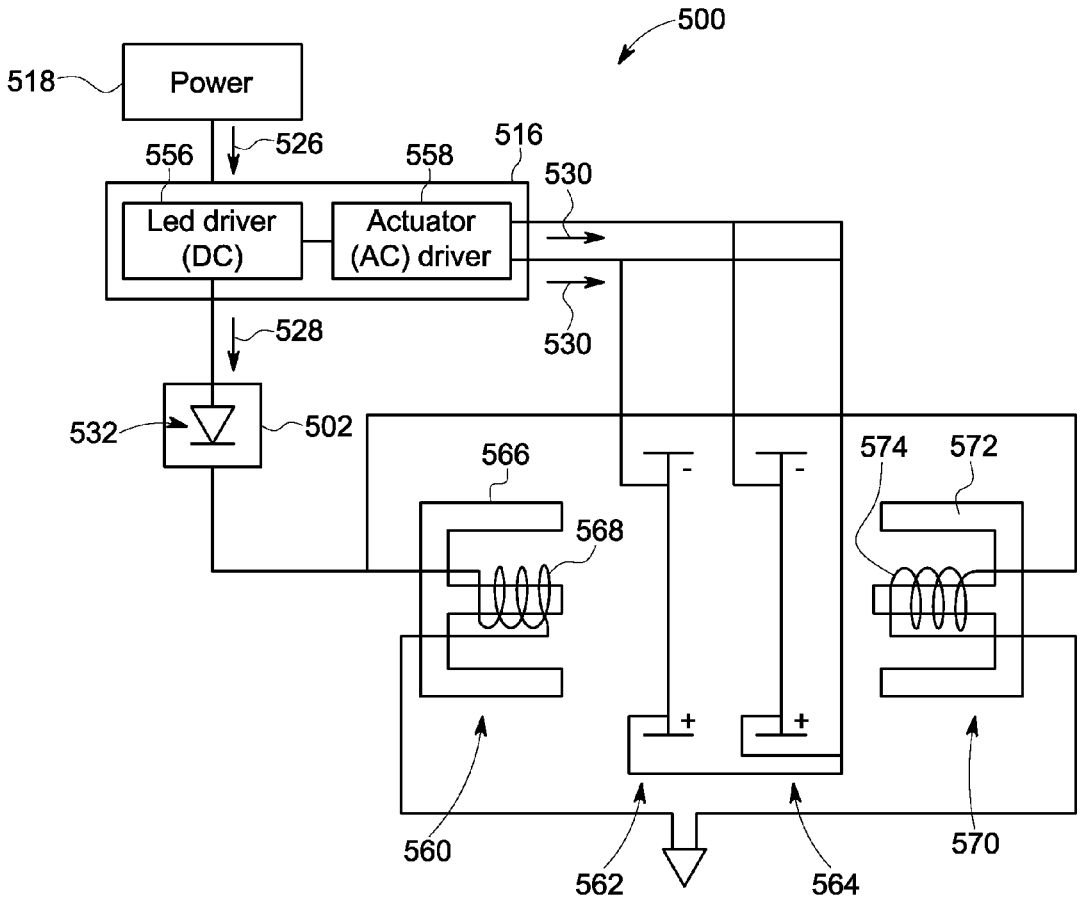
FIG. 5 depicts a schematic diagram of yet another construction for a lighting device, e.g., the lighting device of FIGS. 1 and 2.

FIGS. 4 and 5 depict embodiments of a lamp 400 (FIG. 4) and a lamp 500 (FIG. 5) to illustrate other exemplary constructions for the arrangement of the field generator and actuator. The lighting device 400 of FIG. 4 includes a first field generator 460 that is disposed between a first actuator 462 and a second actuator 464. The first field generator 460 includes a first base element 466 and a first inductor 468. In this example, the magnetic field from the field generator 460 is sufficient to operate the actuators 462, 464 to generate airflow for cooling. During operation, the drive circuit 416 receives the input power signal 426 from the power source 418. The LED driver circuit 456 generates an input 428 that energizes the light source 402 to cause the light-emitting diode (LED) device 432 to generate light. The actuator driver circuit 458 generates an input 450 that operates the actuators 462, 464. The input 428 also causes the field generator 460 to generate a magnetic field that is useful to operating the actuators 462, 464 as discussed herein.

In the example of FIG. 5, in addition to the first field generator 560, which includes the first base element 566 and the first inductor 568, the lighting device 500 also includes a second field generator 570 with a second base element 572 and a second inductor 574. The inductors 568, 574 couple in series with the LED device 532 (and, in one example, in series with each other) to conduct the first input signal 528 to ground 538. During operation, the drive circuit 516 receives the input power signal 526 from the power source 518. The LED driver circuit 556 generates an input 528 that energizes the light source 502 to cause the light-emitting diode (LED) device 532 to generate light. The actuator driver circuit 558 generates an input 530 that operates the actuators 562, 564. The input 528 also causes the field generator 560 to generate a magnetic field that is useful to operating the actuators 562, 564 as discussed herein.

Figure 6:
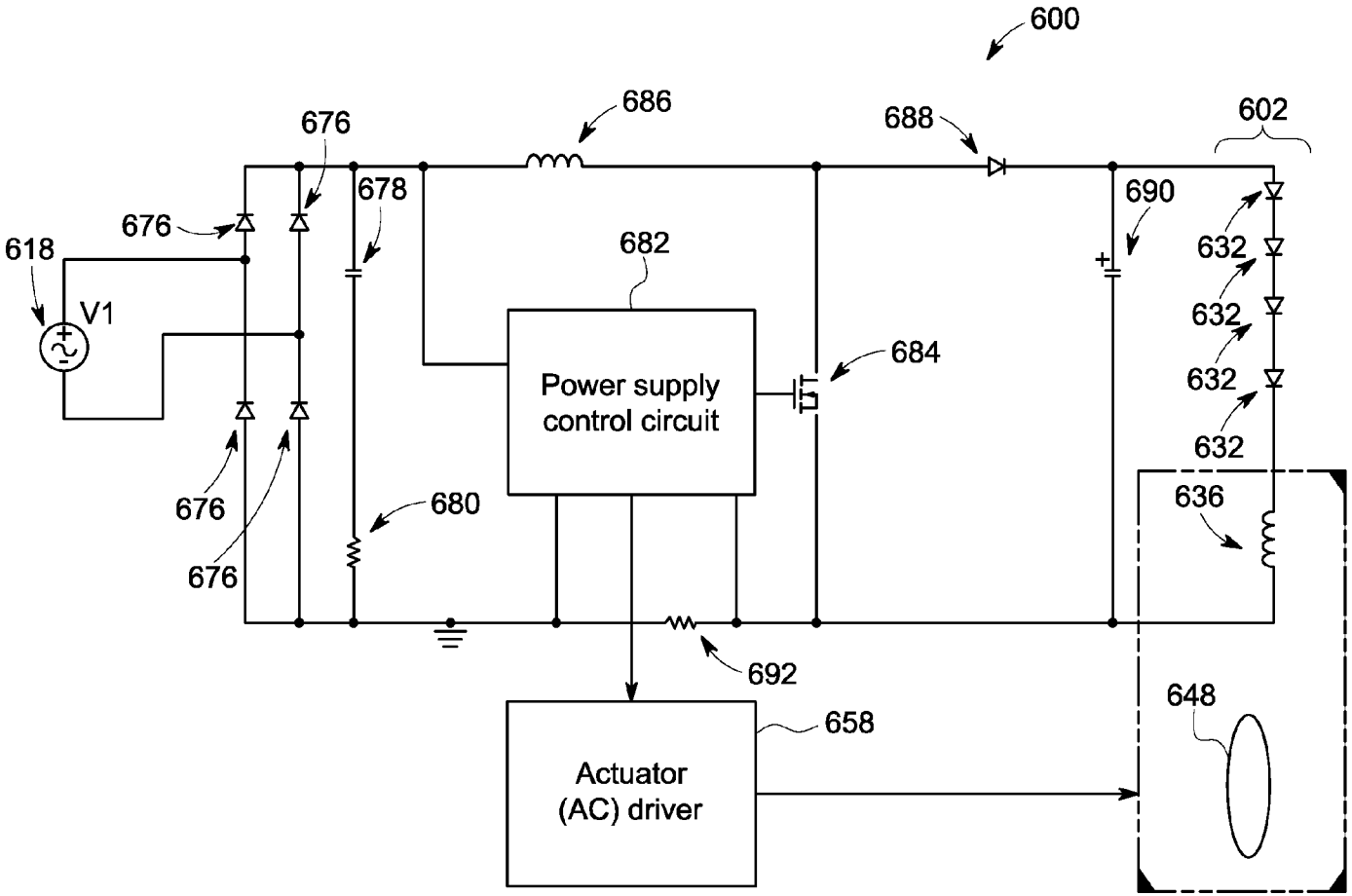
FIG. 6 depicts a schematic wiring diagram for the topology of yet another exemplary lighting device , e.g., the lighting device of FIGS. 1 and 2.

FIG. 6 depicts a wiring schematic that shows topology for an exemplary lighting device 600. This topology includes various components (e.g., resistors, capacitors, switches, diodes, etc.) that are useful and can embody the design. This disclosure also contemplates other configurations of components that would form topologies other than that shown in the figures.

As shown in FIG. 6, the lighting device 600 includes a light source 602 and a power source 618. The light source 602 has a plurality of LED devices 632 coupled in series with an inductor 636. When energized, the inductor 636 magnetically couples with a diaphragm 648. Moving from left to right in FIG. 6, the lighting device 600 also includes a converter component in the form of an AC/DC rectifier with a set of rectifier diodes 676. The AC/DC rectifier converts the input power signal from the power source 618 (e.g., to a DC signal) that can drive the light source 602. The lighting device 600 also includes a filter component, which in this case comprises an RC circuit with a filtering capacitor 678 and a filtering resistor 680. Examples of the RC circuit filter noise and electromagnetic interference from the input power signal. The lighting device 600 further includes a power supply control circuit 682 and a switch 684, the combination of which can regulate the input power signal to the actuator driver 658. In the present example, the lighting device 600 also includes one or more operating components, e.g., an operating inductor 686, an operating diode 688, an operating capacitor 690, and an operating resistor 692. Collectively, the operating inductor 686, the operating diode 688, and the operating capacitor 690 form a resonant tank that modifies the operating parameters (e.g., frequency) of the input power signal to the light-emitting diodes 632. The operating resistor 692 maintains a specified voltage across the power supply circuit 682. Values for the specified voltage can be modified based on the value (e.g., the resistance value) of the operating resistor 692.

In light of the foregoing discussion, embodiments of the lamps (e.g., lamps 100, 200, 300, 400, 500, 600 of FIGS. 1, 2, 3, 4, 5, and 6) afford the benefits of active cooling while improving performance through filtering and/or damping of variations in the drive signals for the light source. In this way, these embodiments can match several constraints, e.g., on cost, manufacturing, and packaging of the lamps that are suitable replacements for conventional incandescent and fluorescent bulbs.

As used herein, an element or function recited in the singular and proceeded with the word "a" or "an" should be understood as not excluding plural said elements or functions, unless such exclusion is explicitly recited. Furthermore, references to "one embodiment" of the claimed invention should not be interpreted as excluding the existence of additional embodiments that also incorporate the recited features.

This written description uses examples to disclose embodiments of the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A lamp, comprising:

a light source;

a field generator electrically coupled with the light source, wherein the field generator comprises a base element and an inductor with a winding wound about the base element, wherein the field generator generates a magnetic field in response to a first input signal that energizes the light source, wherein the inductor couples in series with the light source; and an actuator magnetically coupled with the field generator via the magnetic field.

2. The lamp of claim 1, wherein the light source comprises a light emitting diode device.

3. The lamp of claim 1, wherein the actuator comprises a diaphragm secured about a peripheral edge, and wherein the diaphragm moves between a first position and a second position in response to a second input signal.

4. The lamp of claim 3, wherein the first input signal comprises a direct current signal and the second input signal comprises an alternating current signal.

5. The lamp of claim 1, wherein the field generator comprises a first field generator and a second field generator disposed on opposite sides of the actuator, and wherein the first field generator and the second field generator couple in series with the light source.

6. The lamp of claim 1, further comprising a heat sink in thermal contact with the light source, wherein the heat sink fits within an envelope defining an A-series incandescent bulb.

7. The lamp of claim 1, wherein the base element comprises a material that becomes magnetized in response to the first input signal on the winding.

8. The lamp of claim 1, wherein the base element has a form factor with a pair of outer legs and an inner leg disposed therebetween, and wherein the winding winds about at least the inner leg.

9. A lamp, comprising:

a light emitting diode device;

an active cooling device forming a series circuit with the light emitting diode device and a ground, wherein the active cooling device generates a magnetic field in response to a first input signal that energizes the light emitting diode device.

10. The lamp of claim 9, further comprising a drive circuit that couples with the active cooling device, wherein the drive circuit converts an alternating current input to a direct current input, and wherein the first input signal comprises the direct current input.

11. The lamp of claim 10, wherein the drive circuit generates a second input signal that comprises the alternating current input.

12. The lamp of claim 11, wherein the active cooling device comprises a diaphragm having a first position and a second position, and wherein the diaphragm flexes between the first position and the second position in response to the alternating current input.

13. The lamp of claim 9, further comprising:

a heat sink in thermal contact with the light emitting diode device; and a connector compatible with an Edison-type lamp socket.

14. A lamp, comprising:

a drive circuit generating a first input signal and a second input signal that is different from the first input signal;

a light emitting diode device coupled with the drive circuit to receive the first input signal;

a first inductor coupled in series with the light emitting diode device to conduct the first input signal to ground; and a diaphragm magnetically coupled with the first inductor, wherein the diaphragm comprises material that flexes between a first position and a second position in response to the second input signal from the drive circuit.

15. The lamp of claim 14, wherein the drive circuit comprises a diaphragm driver circuit coupled with the diaphragm, wherein the diaphragm driver circuit provides the second input signal with a waveform that determines a frequency at which the diaphragm flexes between the first position and the second position.

16. The lamp of claim 14, further comprising a base element, wherein the inductor has a winding that winds about the base element, and wherein the base element becomes magnetized in response to the first input signal.

17. The lamp of claim 14, further comprising a second inductor coupled in series with the first inductor, wherein the diaphragm is magnetically coupled with the second inductor.

18. The lamp of claim 14, wherein the drive circuit comprises an LED driver circuit with a rectifier coupled with the light emitting diode device.

* * * * *